United States Patent [19]

Ito et al.

[11] Patent Number: 4,745,887

[45] Date of Patent: May 24, 1988

[54] ENGINE PROVIDED WITH COOLING DEVICE IN MOTORCYCLE

[75] Inventors: Hiroyuki Ito; Kazuoki Ukiana; Kaoru Wachigai, all of Saitama, Japan

[73] Assignee: Honda Giken Kogyo Kabushiki Kaisha, Tokyo, Japan

[21] Appl. No.: 27,579

[22] Filed: Mar. 18, 1987

[30] Foreign Application Priority Data

Mar. 18, 1986 [JP] Japan ..... 61-60404
Mar. 18, 1986 [JP] Japan ..... 61-39626[U]

[51] Int. Cl.[4] ..... F01L 1/04
[52] U.S. Cl. ..... 123/90.31; 123/41.49
[58] Field of Search ..... 123/41.48, 41.49, 90.31; 180/218, 291; 280/63

[56] References Cited

U.S. PATENT DOCUMENTS 4,445,587 5/1984 Hillman ..... 123/41.48

*Primary Examiner*—Stephen F. Husar
*Attorney, Agent, or Firm*—Lyon & Lyon

[57] ABSTRACT

A motorcycle engine having a cooling device is constructed as an OHC type multi-cylinder engine arranged on a vehicle frame with a plurality of cylinders being aligned perpendicularly to the longitudinal direction of the body frame, wherein a radiator provided with a forced cooling fan and a carburetor leading to engine intake ports are disposed forwardly and rearwardly of the engine, respectively, a timing transmission device for driving a valve-actuating cam shaft of the engine is arranged so as to deviate to one side from the center of the cylinder block in the alignment direction of said cylinders, the timing transmission device and the radiator fan being arranged side-by-side in the longitudinal direction of the frame, a plurality of bearing holders are provided separately on the engine cylinder head correspondingly to the cylinders to rotatably support a valve-actuating cam shaft extending in the alignment direction of the cylinders, and a head cover covering the cylinder head provides wind guiding passages of a concave cross section extending in the longitudinal direction of the frame through between the adjacent bearing holders, outlets of the wind guiding passages being oppossed to the carburetor.

2 Claims, 8 Drawing Sheets

ENGINE PROVIDED WITH COOLING DEVICE IN MOTORCYCLE

BACKGROUND OF THE INVENTION

1. Field of the Invention

The present invention relates to the construction of a motorcycle engine provided with a cooling device.

2. Description of the Prior Art

It has conventionally been known in a motorcycle to arrange a radiator having a forced cooling fan at a position forwardly of an engine which is carried on a vehicle body frame and a carburetor leading to intake ports of the engine at a position rearward of the engine (see Japanese Patent laid open No. 58-188770 (188770/1983).

The prior arrangement structure requires the engine and the radiator to be arranged as close as possible in order to make it compact in size as a whole and to facilitate mounting of the same to the vehicle body frame, and it also requires piping between the engine and the radiator to be shortened. However, since the radiator is provided with a forced cooling fan at its backside and the motor portion of the fan projects toward the engine, the motor portion interfers with the engine and it is difficult to arrange the radiator close to the engine. When the engine is an OHC (over-head cam shaft)type straight multi-cylinder engine and is laterally placed (the alignment of the cylinders is directed laterally), casing portion of a timing transmission mechanism for driving a valve-actuating cam shaft bulges outward from a head of the engine. Therefore, it becomes more difficult to arrange the engine and the radiator at positions adjacent to each other. Moreover, the bulged casing portion stands as an obstruction in front of a carburetor, the travelling wind is difficult to hit the carburetor, which causes a rise in temperature of the carburetor, adversely affecting the intake efficiency of the engine.

SUMMARY OF THE INVENTION

The present invention has been proposed in view of the foregoing, and it is an object of the invention to provide an engine provided with a cooling device in a motorcycle, which is constructed as an OHC type straight multi-cylinder engine having a compact size and a simple structure and which is arranged directly laterally on a vehicle body frame, wherein a radiator having a forced cooling fan is disposed at as close a position as possible to the engine and the travelling wind is positively guided to the front portion of a carburetor for effectively cooling.

For achieving the above described object, according to a first aspect of the present invention, there is provided a motorcycle engine having a cooling device which is constructed as an OHC type multi-cylinder engine arranged on a vehicle body frame with a plurality of cylinders being aligned in a direction perpendicular to the longitudinal direction of the vehicle body frame, wherein a radiator is disposed forwardly of the engine and is equipped with a forced cooling fan, a timing transmission device for driving a valve-actuating cam shaft of the engine is arranged so as to deviate in one direction from the center of a cylinder block in the alignment direction of said cylinders, and the timing transmission device and the forced cooling fan of the radiator are arranged in side-by-side relation and distanced laterally on the vehicle body frame.

With the above described arrangement, the forced cooling fan which is to project from the backside of the radiator toward the engine, in particular its motor portion, and a head portion of the engine bulged toward the radiator are disposed side-by-side in an overlapping fashion in the longitudinal direction of the vehicle body frame and do not interfere with each other. This permits the engine to be arranged as close as possible to the radiator provided with the forced cooling fan, making the whole arrangment compact and facilitating mounting of these equipments to the vehicle body frame and further shortening the piping connecting the radiator and the engine. Therefore, the cooling efficiency is improved and a cost reduction is achieved.

In addition to the aforementioned arrangement, a timing transmission chamber to accomodate the timing transmission device therein is formed bulged sidewardly of the cylinder block from a location between the adjacent cylinders, a water jacket is formed in the cylinder block continuously to surround the outer periphery of the plurality of cylinders, and if the water jacket is communicated with a water intake port opening to the cylinder block as well as with a water outlet port opening to a lower surface of a cylinder head, it is ensured that a continuous water jacket can be formed over the whole region of the cylinder block and the cooling water can pass through the water jacekt with a little resistance in a continuous flow from the water inlet port to the water inlet port, whereby the cooling efficiency of engine can largely be increased. Also, the water jacket structure of the cylinder block is simplified and its casting cost can be reduced.

Furthermore, according to a second aspect of the present invention, there is provided a motorcycle engine having a cooling device which is constructed as an OHC type multi-cylinder engine arrangd on a vehicle body frame with a plurality of cylinders being aligned in a direction perpendicular to the longitudinal direction of the vehicle body frame, wherein a carburetor leading to intake ports of the cylinders is disposed rearwardly of the engine, a plurality of independent bearing holders are provided separately on a cylinder head of the engine so as to correspond to the cylinders and rotatably support a valve-actuating cam shaft extending in the alignment direction of the cylinders, and wherein a head cover covering the cylinder head is formed with wind guiding passages having a concave cross section and extending in the longitudinal direction of the frame through between the adjacent bearing holders, outlets of the wind guiding passages being designed to face the carburetor.

With this arrangement, even if the head portion of the engine stands as a large obstruction in front of the carburetor, a cool travelling wind is positively guided toward the front surface of the carburetor through the wind guiding passages. As a result the carburetor can be air-cooled effectively. This serves to increase the intake efficiency and air-cool the head of the engine effectively.

The above and other objects, features and advantages of the present invention will be apparent from the following description of one preferred embodiment which will be made in detail in connection with the accompanying drawings.

BRIEF DESCRIPTION OF THE DRAWINGS

Drawings show one embodiment of the present invention wherein.

DESCRIPTION OF PREFERRED EMBODIMENT

A description will be made hereinafter of one embodiment of the present invention with reference to the attached drawings.

In the following description, words of "front and rear" and "left and right" are used in respect to an advancing direction of a motorcycle.

Figure 1:
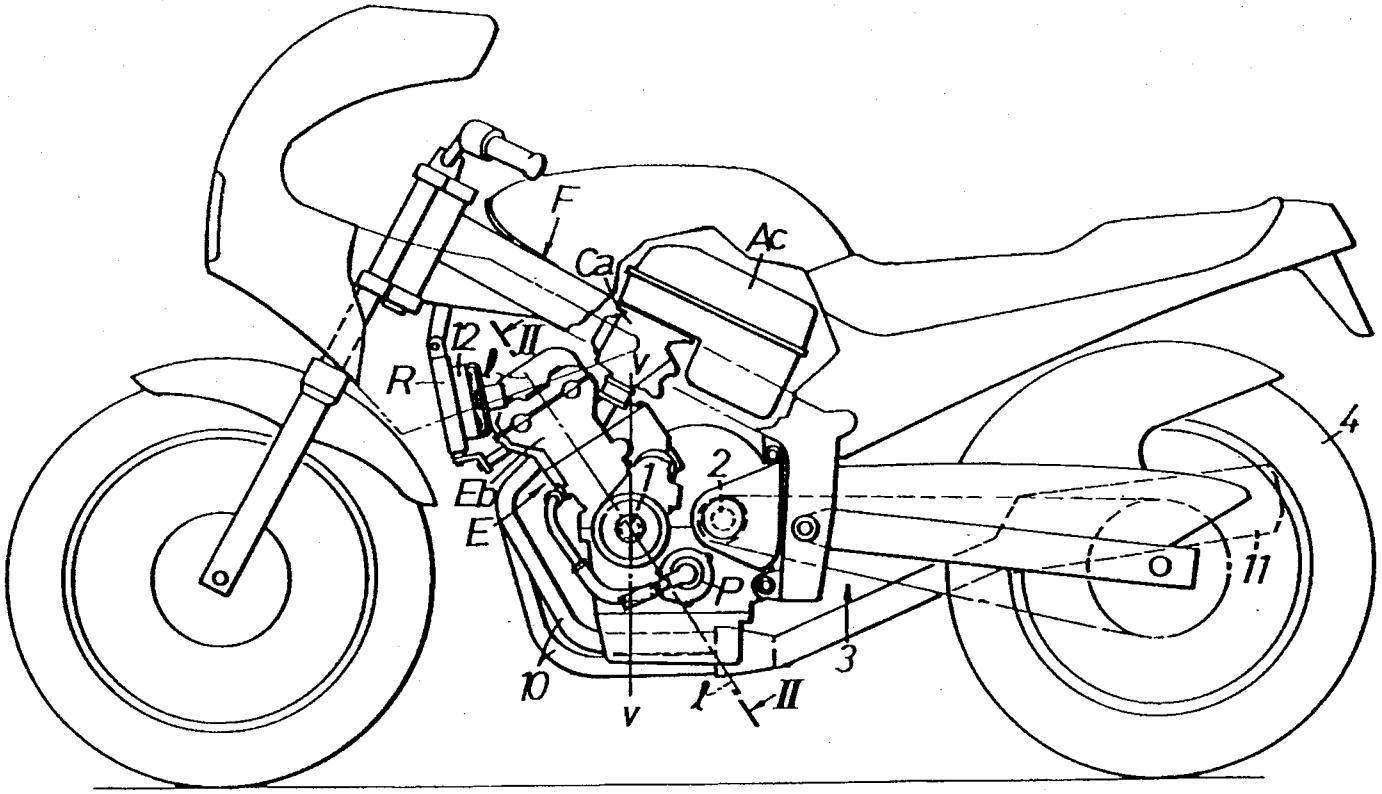
FIG. 1 is a side view showing a motorcycle carrying an engine according to the present invention.

In FIG. 1, on a vehicle body frame F is mounted an OHC type water cooled straight four cylinder engine E in a lateral direction, that is, a plurality of cylinders are aligned in a direction intersecting perpendicularly to an advancing direction of the vehicle. An output shaft 2 leading from a crank shaft 1 of the engine E is transmitted to a rear wheel 4 through a power transmitting mechanism 3.

An engine block Eb of the engine E containing a cylinder block 5 and a cylinder head 6 is inclined forward, and its axis of cylinder l—l is inclined forward about 35° from a vertical line v—v.

Figure 3:
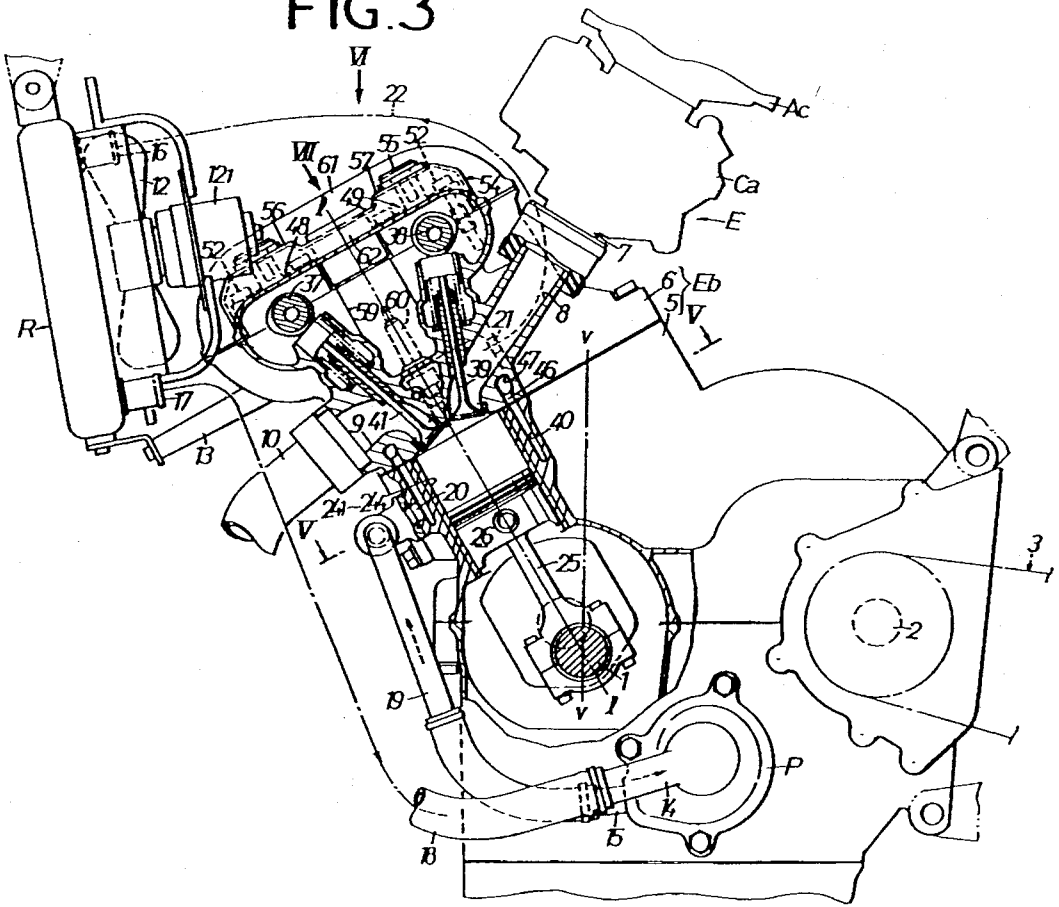
FIG. 3 is a cross sectional view taken along line III—III of FIG. 2.
Figure 6:
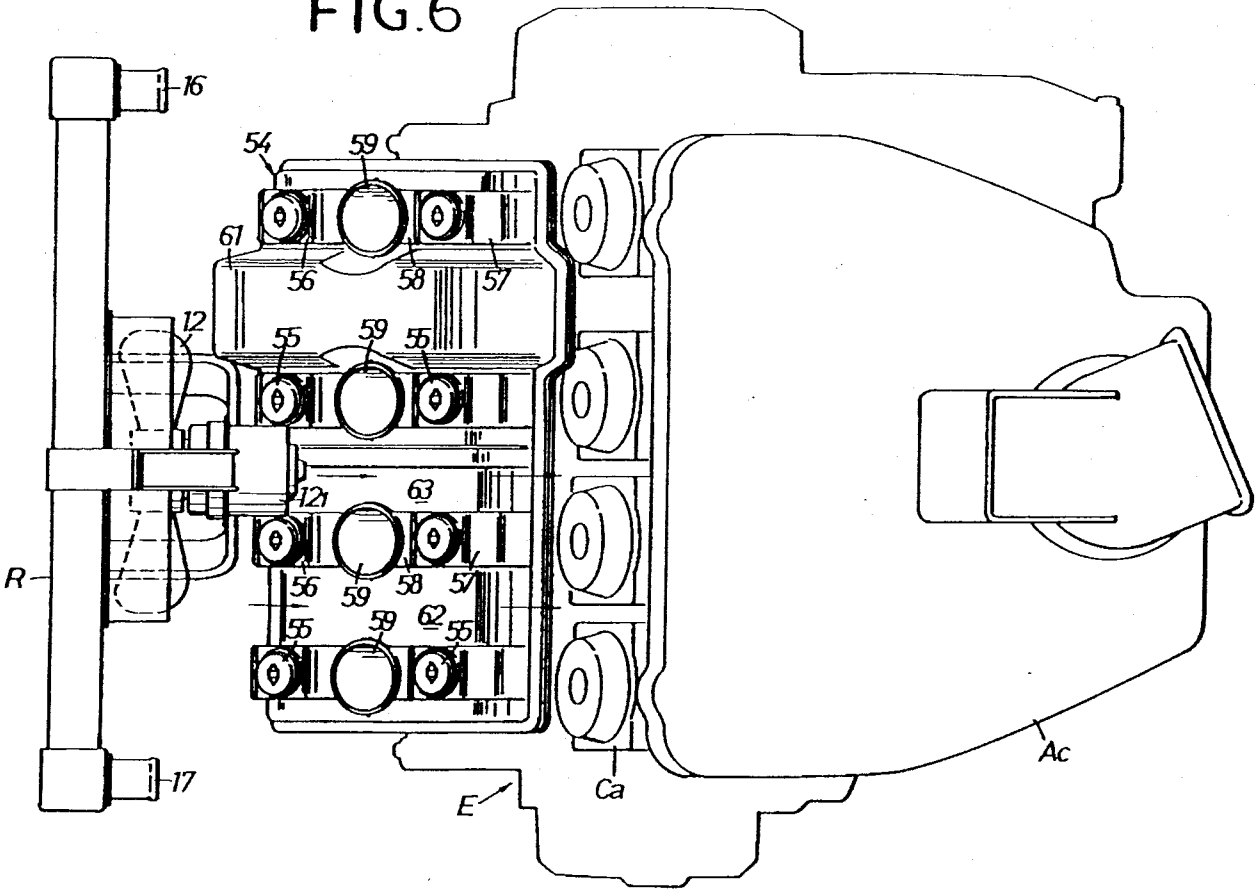
FIG. 6 is a plan view seen toward arrow VI of FIG. 3.

As illustrated in FIGS. 1, 3 and 6, a quadruple carburetor Ca connected with an intake system is arranged in parallel with the block Eb in the rear of the latter. Four intake passages 7 of the carburetor Ca are connected to four intake ports 8 opening to a rear surface of the engine block Eb, and an air cleaner Ac is connected to an inlet of the carburetor Ca. At the front surface of the engine block Eb are opened four exhaust ports 9 to which exhaust pipes 10 are connected respectively. These exhaust pipes 10 extend from the front surface of the engine block Eb, pass below the lower surface of the block to the rearward and are connected to a muffler 11.

As shown in FIGS. 1 to 3 and 6, a radiator R connected to a water cooling system of the engine E is arranged in the front of the engine. The radiator R is provided with a forced cooling fan 12 at its rear surface and is suspended on the vehicle body frame F, the lower portion of the radiator R being held on the engine block Eb through the intermediary of a stay 13. Thus, the forced cooling fan 12, in particular its motor portion $12_1$, protrudes toward the engine E. However, by an improvement applied to the structure of the engine E, as will be mentioned hereinafter, the motor portion $12_1$ can be located at a position close to the engine E without interferring with the head of the engine.

As obviously shown in FIG. 3, a water pump P driven by the crank shaft 1 is provided on a left side surface of the lower portion of the engine E. A suction side 14 of the water pump P is communicated with an outlet 17 of the radiator R through the intermediary of a water conduit 18. A discharge side 15 of the water pump P is communicated via a water supply pipe 19 with a water inlet port 20 opened at the cylinder block 15. Also, an exhaust port 21 opened at the cylinder head 6 is communicated with an inlet port 16 of the radiator R through a water conduit 22.

Figure 2:
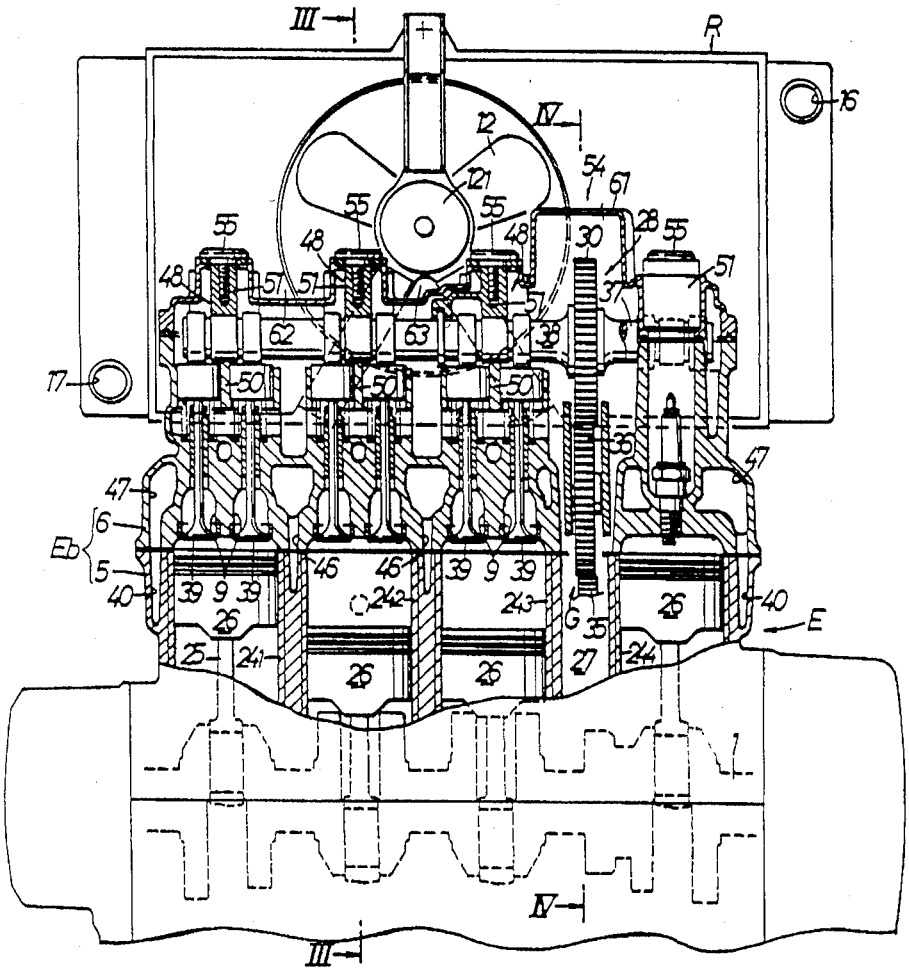
FIG. 2 is an enlarged cross sectional view taken along line II—II of FIG. 1.

As shown in FIGS. 2 and 3, in the cylinder block 5 a first to fourth cylinders $24_1$–$24_4$ are arranged in series in left and right directions, that is, in a direction perpendicular to front and rear directions of the vehicle body frame. Into these cylinders $24_1$–$24_4$ are slidably fitted respective pistons 26 connected with the crank shaft 1 through connecting rods 25.

Figure 4:
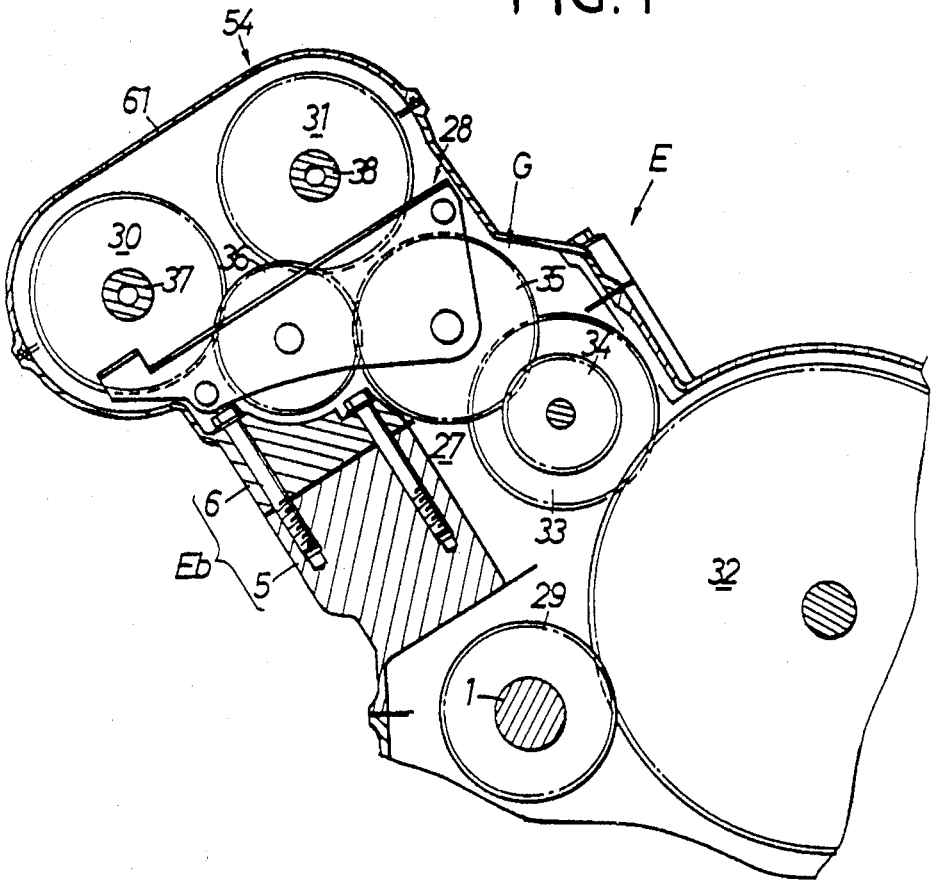
FIG. 4 is a cross sectional view taken along line IV—IV of FIG. 2.
Figure 5:
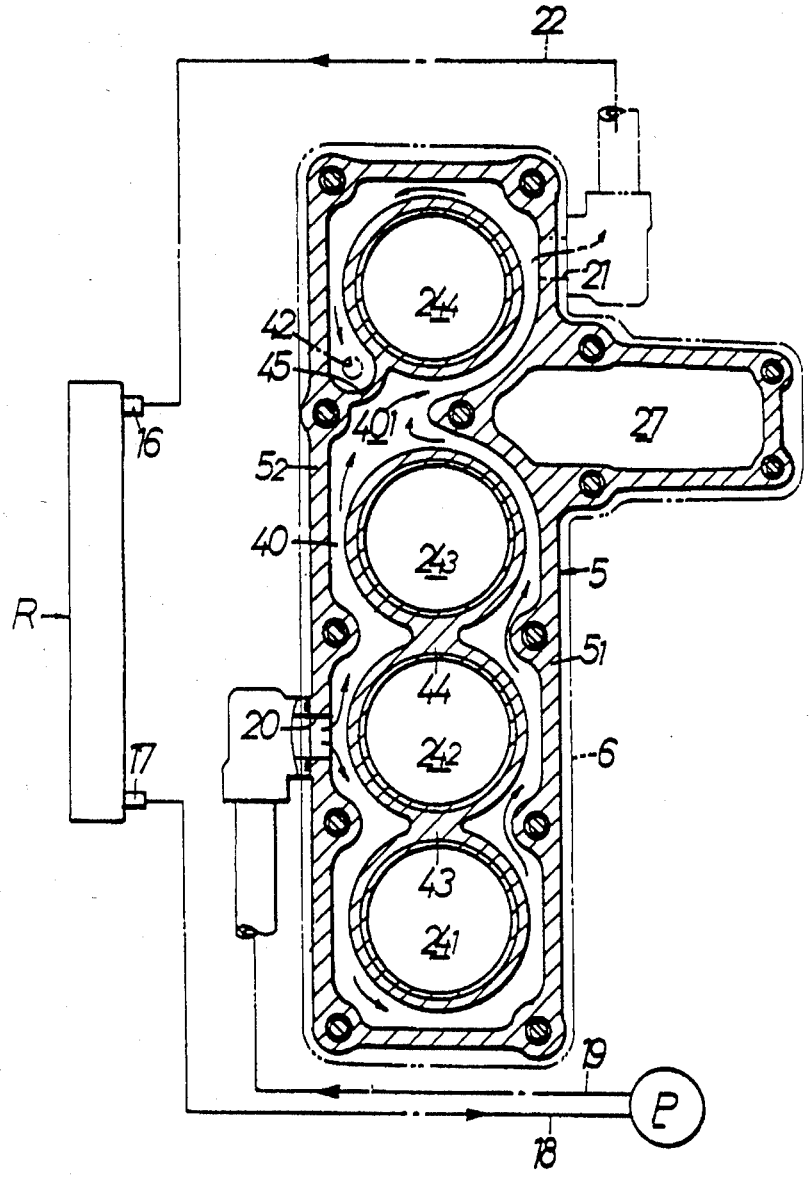
FIG. 5 is a plan view showing a cylinder block taken slong line V—V of FIG. 3.

As obviously illustrated in FIGS. 4 and 5, from the engine block Eb is integrally bulged a timing transmission chamber 27. The timing transmission chamber 27 is deviated from the center of the engine block Eb to the right side in the alignment direction of the first to fourth cylinders $24_1$–$24_4$ and is projected rearward from an intake-side wall $5_1$ of the block Eb between the third and fourth cylinders $24_3$ and $24_4$.

A timing transmission device 28 is accomodated in the timing transmission chamber 27. The timing transmission device 28, for example, consists of a gear train which includes a driving gear 29 on the crank shaft 1, a pair of driven gears 30 and 31 secured respectively to a pair of valve-actuating cam shafts 37 and 38 on the cylinder head 6, and a gear group G operatively connecting the driving gear 29 and the driven gears 30 and 31. The gear group G comprises a first gear 32 of large diameter meshed with the driving gear 29, a second gear 33 meshed with the first gear 32, a third gear 34 of small diameter formed integrally with the second gear 33, a fourth gear 35 meshed with the third gear 34, and a fifth gear 36 meshed with the fourth gear 35 and with the pair of driven gears 30 and 31. Rotation of the crank shaft 1 is transmitted to the pair of valve-actuating cam shafts 37 and 38 at a reduction ratio of $\frac{1}{2}$ through the intermediary of the timing transmission device 28 consisting of the gear train.

Since the timing transmission chamber 27 is deviated from the center of the engine block Eb to the right side in the alignment direction of the first to fourth cylinders $24_1$–$24_4$ as mentioned above, a water jacket 40 posing a little flow resistance is formed over the whole region of the cylinder block 5. The water jacket 40 is designed to communicate with the water inlet port 20 opened at the cylinder block 5 and with a water outlet port 42 (FIG. 5). Because the cylinder block 5 is of an open deck type, an upper surface of the water jacket 40 is opened to the deck surface. However, that upper surface is, in assembled state, closed by the lower surface of the cylinder head 6 superposed thereon.

The water jacket 40 is formed to surround the outer periphery of the first to third cylinders $24_1$–$24_3$ connected together in siamese form through boundary walls 43 and 44, and the outer periphery of the fourth cylinder $24_4$. In order to form the timing transmission chamber 27 in the above-mentioned manner, the water jacket 40 has a part extended into between the third and fourth cylinders $24_3$ and $24_4$ which are separated at a distance greater than distances between other cylinders, thereby providing a communicating passage $40_1$. The communicating passage $40_1$ establishes a connection between the water jacket portion around the third cylinder $24_3$ and the water jacket portion around the fourth cylinder $24_4$. An exhaust-side wall $5_2$ of the cylinder block 5 is formed at a portion thereof opposing to the second cylinder $24_2$ with the water inlet port 20 which leads from the discharge side 15 (FIG. 3) of the water pump P. Between the exhaust-side wall $5_2$ and the fourth cylinder $24_4$ is formed a partition wall 45 that partitions the water jacket 40. Adjacent the partition wall 45, the water jacket 40 comes to its end at a location between the partition wall 45 and the exhaust side wall $5_2$. The water jacket 40 is communicated with the water outlet port 42 as a final outlet opening to the side of the cylinder head 6, the water outlet port 42 being communicated with a water jacket 47 formed on the side of the cylinder head 6. The cooling water from the water pump P flows into the water jacket 40 through the water supply pipe 19 and passes the interior of the jacket 40 continuously along the outer periphery of the first to third cylinders $24_1$–$24_3$ as shown by arrows in FIG. 5. Then it passes the communicating passage $40_1$ between the third and fourth cylinders $24_3$, $24_4$, and flows continuously into the water jacket 47 on the cylinder head 6 side from the water outlet port 42 while bypassing the outer periphery of the fourth cylinder $24_4$. Thus, when the cooling water flows through the water jacket 40 as mentioned above, it can cool effectively the cylinder block 5, in particular, portions around the first to fourth cylinders $24_1$–$24_4$.

At the lower surface of the cylinder head 6 are opened a plurality of small bores 46 for communicating the water jacket 40 in the cylinder block 5 with the water jacket 47 in the cylinder head 6. The cooling water that flows through the water jacket 40 partially passes through the small bores 46 to flow into the water jacket 47 on the cylinder head 6 side.

Figure 8:
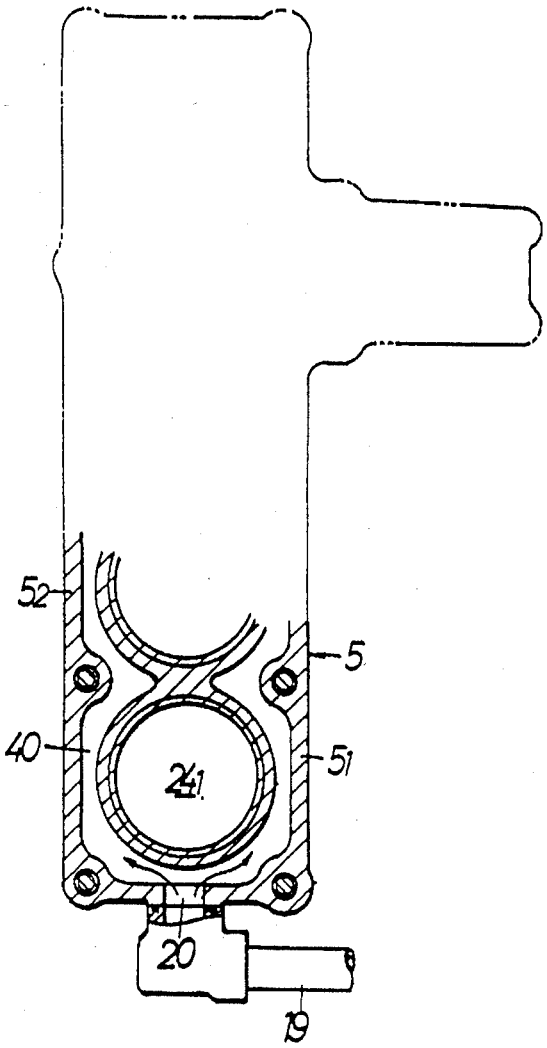
FIG. 8 is a plan view similar to FIG. 5, showing a variant of the cydinder block.

As a modification of the cylinder block 5, a water inlet port 20 may be provided, as shown in FIG. 8, at one end wall of the cylinder block 5 on the side of the first cylinder $24_1$ in the longitudinal direction of the block. In this modification, the water supply pipe 19 connecting the water inlet port 20 and the discharge side 14 of the water pump P can be shortened.

As shown in FIGS. 2 and 3, on the cylinder head 6 of the engine block Eb are rotatably supported the pair of valve-actuating cam shafts 37 and 38 which are operable directly to open and close a plurality of intake valves 39 and a plurality of exhaust valves 41, respectively. Description will next be made of the supporting structure for the pair of valve-actuating cam shafts 37 and 38.

The pair of valve-actuating cam shafts 37 and 38 extend parallel to each other on opposite sides of the aligned first to fourth cylinders $24_1$–$24_4$ in the alignment direction of those cylinders. The valve-actuating cam shafts 37 and 38 are rotatably supported respectively by four bearing holders 48 . . . of a front row and four bearing holders 49 . . . of a rear row. These bearing holders 48 . . . and 49 . . . are arranged on both sides of a central part of the cylinders $24_1$–$24_4$ in an oposed manner and are each constituted by a bearing half portion 50 formed integrally on the cylinder head 6 and a bearing cap 51 fixed to the bearing half portion 50 by means of a bolt 52. The valve-actuating cam shafts 37 and 38 are rotatably supported in a bearing hole defined by the bearing half portion 50 and the bearing cap 51 through the intermediary of bearings.

Figure 7:
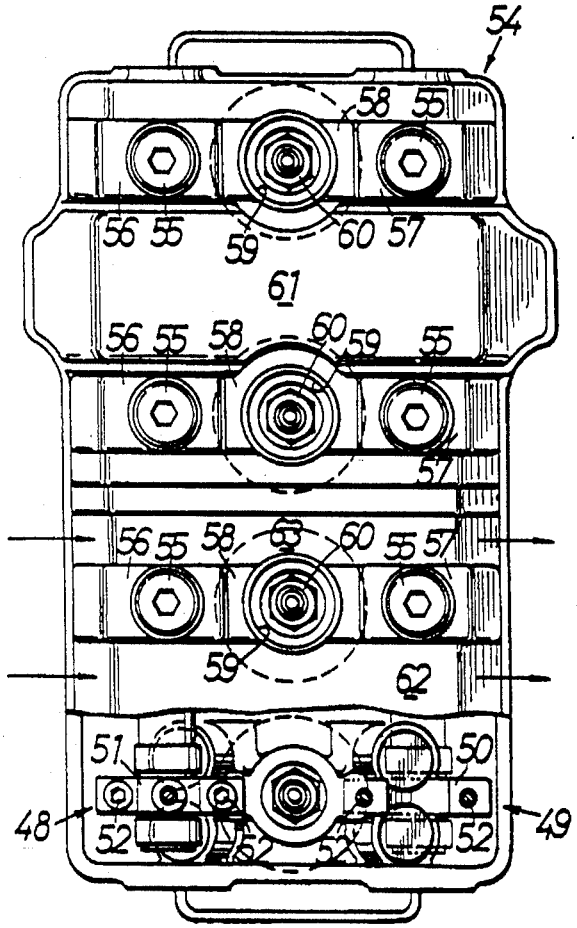
FIG. 7 is a partial cross sectional plan view seen in the direction of arrow VII of FIG. 3.

As shown in FIG. 7, on the cylinder head 6 is fixed by a plurality of bolts 55 . . . a head cover 54 which covers the valve-actuating mechanism containing the pair of valve-actuating cam shafts 37 and 38. The head cover 54 is provided with front and rear convex portions 56 and 57 protruding upward along the valve-actuating cam shafts 37 and 38, so as to cover the shafts as shown in FIGS. 3 and 6. Between the convex portions 56 and 57 is formed a center concave portion 58 in which mounting bores 59 . . . are provided in a row for mounting of four ignition plugs 60 corresponding to the first to fourth cylinders $24_1$–$24_4$.Also, the head cover 54 has at a position deviated from the center to the right side a protruding portion 61 extending in the front and rear direction of the vehicle, that is, in the width direction of the head cover 54, to cover the upper opened surface of the timing transmission chamber 27. Accordingly, upper half portions of the pair of driven gears 30, 31 of the timing transmission device 28 are covered with the protruding portion 61, as shown in FIG. 4.

As illustrated in FIGS. 2 and 6, the head cover 54 is provided with wind guiding passages 62, 63 of a concave cross-section opened at front and rear ends and extending through between the first and second cylinders $24_1$, $24_2$ and between the second and third cylinders $24_2$, $24_3$, except between the third and fourth cylinders $24_3$, $24_4$, that is, between the adjacent bearing holders 48, 48. Accordingly, when the motorcycle runs, the travelling wind partly flows to the rear of the engine E through the wind guiding passages 62, 63 as shown by arrows in FIGS. 6 and 7 thereby to hit the front surface of the quadruple carburetor Ca lying in the rear of the wind guiding passages 62, 63. Thus, the head of the engine E and the carburetor Ca are air cooled.

As apparent from FIGS. 2, 3 and 6, the radiator R is arranged forwardly of the engine block Eb to match therewith in the lateral direction. The forced cooling fan 12 on the rear surface of the radiator R takes a position laterally central of the radiator R and therefore forwardly of a laterally central portion of the engine block Eb. The forced cooling fan 12 projects rearwardly toward the engine block Eb and in particular its motor portion $12_1$ reaches a location near the head cover 54. However, since the protruding portion 61 which protrudes so as to form the most front of the head cover 54 is deviated from the center to one lateral side, the motor portion $12_1$ and the protruding portion 61 are to have relatively deviated positions in the lateral direction to each other. Therefore, even if they overlap with each other in the longitudinal direction of the vehicle, their interference would not occur. This makes it possible to arrange the radiator R close to the engine E.

In the embodiment mentioned above, the present invention has been described with respect to the case applied to a DOHC type engine. However, the present invention, of course, can be embodied in an SOHC type engine.

What is claimed is:

1. An engine provided with a cooling device in a motorcycle, wherein the engine is constructed as an OHC type multi-cylinder engine arranged on a body frame of the motorcycle and has a plurality of cylinders aligned in a direction perpendicular to a longitudinal direction of said body frame, comprising a radiator disposed forwardly of said engine and having a forced cooling fan, and a timing transmission device for driving a valve-actuating cam shaft of said engine arranged so as to deviate toward one side from a center of a cylinder block in the alignment direction of said cylinders, said timing transmission device and said forced cooling fan of said radiator being arranged in side-by-side fashion in a lateral direction of said body frame.

2. The engine according to claim 1 wherein a timing transmission chamber to accommodate the timing transmission device therein is formed bulged sidewardly of the cylinder block from a location between the cylinders which are adjacent to each other, a water jacket is formed in the cylinder block continuously to surround an outer periphery of said plurality of cylinders, said water jacket being communicated with a water inlet port opening to said cylinder block and a water outlet port opening to a lower surface of a cylinder head.

* * * * *